US006726782B2

(12) United States Patent
Nakai et al.

(10) Patent No.: US 6,726,782 B2
(45) Date of Patent: Apr. 27, 2004

(54) ULTRA-LOW CARBON STEEL SHEET

(75) Inventors: Syuji Nakai, Kashima (JP); Tatsuo Kanai, Kashima (JP); Yoshihiko Higuchi, Kashima (JP); Sei Hiraki, Kashima (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/989,530

(22) Filed: Nov. 21, 2001

(65) Prior Publication Data

US 2002/0096232 A1 Jul. 25, 2002

(30) Foreign Application Priority Data

Nov. 27, 2000 (JP) ..... 2000-359370
Aug. 30, 2001 (JP) ..... 2001-261501

(51) Int. Cl.[7] ..... C22C 38/06; C22C 38/02; C22C 38/04

(52) U.S. Cl. ..... 148/320; 148/330; 148/332; 148/333

(58) Field of Search ..... 148/320, 333, 148/332, 330

(56) References Cited

U.S. PATENT DOCUMENTS 3,950,191 A * 4/1976 Ito et al. ..... 148/330

FOREIGN PATENT DOCUMENTS

JP 6-17111/1994 1/1994
JP 6-172925/1994 6/1994
JP 7-207403/1995 8/1995
JP 11-36045/1999 2/1999
JP 11-279678/1999 10/1999
JP 11-279721/1999 10/1999
JP 2000-1746 1/2000
JP 2000129332 A * 5/2000 ..... B22D/11/00

OTHER PUBLICATIONS

English abstract of Japanese publciation 2000144330A, Derwent 416079, May 26, 2000.*

* cited by examiner

*Primary Examiner*—Deborah Yee
(74) *Attorney, Agent, or Firm*—Burns, Doane, Swecker & Mathis, L.L.P.

(57) ABSTRACT

A steel sheet with a thickness of at least 0.30 mm is made of an ultra-low carbon steel with a chemical composition including C: at most 0.010 %, Si: at most 0.5 %, Mn: at most 1.5 %, P: at most 0.12 %, S: at most 0.030 %, Ti: at most 0.10 %, Al: at most 0.08 %, and N: at most 0.0080 %. The total number of non-metallic inclusions observed under a microscope in sixty fields in a sample prepared in accordance with JIS G0555 is at most 20. During manufacture of the steel, the amount of FeO+MnO in slag in a ladle at the time of continuous casting is controlled to at most 15 %, and the throughput at the time of casting is made at most 5 tons per minute. The steel sheet does not develop pin hole defects or press cracks caused by inclusions when used for applications such as motor housings or oil filter housings requiring severe press forming.

30 Claims, 2 Drawing Sheets

ULTRA-LOW CARBON STEEL SHEET

BACKGROUND OF THE INVENTION

1. Field of the Invention

This invention relates to an ultra-low carbon steel sheet and a method for its manufacture. More particularly, it relates to an ultra-low carbon steel sheet having a thickness of at least 0.30 millimeters and having a low tendency to experience forming defects such as pin hole defects or press cracks originating at inclusions even when subjected to press forming of products of complicated shape with large deformation, such as during the manufacture by press forming of products such as electric motor housings or oil filter housings, and to a method for manufacturing such an ultra-low carbon steel sheet.

2. Description of the Related Art

Annealed cold rolled steel sheet has typically been used as a material for the manufacture of products by press forming. The cold rolled steel sheet for this purpose has primarily been low carbon aluminum killed steel which has been annealed by batch annealing.

In recent years, in the manufacture of cold rolled steel sheet for press forming, there has been a shift towards the use of continuous annealing because of its higher productivity. Furthermore, there has been a shift towards the use of ultra-low carbon steel sheet having good formability in applications to products formed with large deformation.

However, when ultra-low carbon steel is used to manufacture products such as motor housings or oil filter housings requiring a high degree of pressing, there are cases in which forming defects such as pin hole defects and press forming cracks occur.

Can manufacture, which is similar to the manufacture of products such as motor housings or oil filter housings, typically employs cold rolled steel sheet having a thickness of less than 0.30 millimeters. Can manufacture entails an even higher level of forming than does the manufacture of motor housings or oil filter housings, and many measures have been proposed for suppressing forming defects during can manufacture.

For example, Japanese Published Unexamined Patent Application Hei 6-172925/1994 and Hei 7-207403/1995 disclose methods for finely dispersing the amount of inclusions in a slab.

Japanese Published Unexamined Patent Application Hei 6-17111/1994 discloses a method for reducing the amount of inclusions in steel by decreasing the amounts of FeO and MnO in slag using a Ca—, or Mg-containing alloy or a reducing agent.

Japanese Published Unexamined Patent Application Hei 11-36045/1999 and Hei 11-279678/1999 also disclose controlling the composition of inclusions as a method of preventing defects.

However, the above-mentioned disclosures relate to low carbon aluminum killed steel. These steels have many aspects which make them inappropriate as cold rolled steels to be subjected to severe forming in the manufacture of products having a complicated shape such as automotive components. In this specification, severe forming for such applications will be referred to as complex deep drawing.

Japanese Published Unexamined Patent Application Hei 11-279721/1999 discloses a method of decreasing inclusions in a low carbon steel, but that steel is for use as tin plate or tin-free steel for can manufacture having a thickness of at most 0.26 millimeters.

Japanese Published Unexamined Patent Application 2000-1746 discloses a method of preventing the formation of inclusions, but that method requires the addition of Ca and/or rare earth metals, so it has the drawback that even if oxide inclusions mainly comprising FeO or MnO are reduced, Ca-containing inclusions or rare earth metal-containing inclusions are increased.

An RH vacuum treatment apparatus is usually used for secondary refining during the manufacture of ultra-low carbon steel, as described in Japanese Published Unexamined Patent Application Hei 11-36045/1999 and Japanese Published Unexamined Patent Application 2000-1746. Vacuum decarburization and deoxidation after the decarburization employing an RH vacuum treatment apparatus are typical secondary refining methods.

SUMMARY OF THE INVENTION

An object of the present invention is to provide steel sheet having a thickness of at least 0.30 millimeters and formed of an ultra-low carbon steel having a carbon content of at most 0.010% and which can be subjected to heavy but fine forming, such as during the manufacture of motor housings or oil filter housings, with reducing the occurrence of forming defects such as pin hole defects and press forming cracks.

Another object of the present invention is to provide a method of manufacturing such a steel sheet.

The present inventors performed investigations as to why cold rolled steel sheet with a thickness of at least 0.30 mm for press forming is more subject to pin holes and press cracks when the sheet is made of ultra-low carbon steel than when it is made of low carbon aluminum killed steel. As a result, they made the following discoveries concerning means for suppressing such defects.

(1) Low carbon aluminum killed steel undergoes powerful deoxidation treatment when being tapped from a converter. In addition, considerable time elapses between tapping and the start of vacuum degassing as the ladle is being moved or other operations are taking place. As a result, the majority of the deoxidation products which are formed during tapping have already floated to the top of the molten steel in the ladle during the time until the start of vacuum degassing treatment, and they are absorbed and removed by the slag on the surface of the molten steel. Inclusions are removed during vacuum degassing treatment.

In contrast, ultra-low carbon steel does not undergo any deoxidation treatment at the time of tapping from a converter, or it undergoes only mild deoxidation treatment from the addition of a small amount of aluminum, and deoxidation is carried out after decarburization by vacuum degassing treatment. For this reason, the length of time between deoxidation and casting is short, and compared to the case of low carbon aluminum killed steel, a large amount of oxide inclusions remain in the steel. Such oxide inclusions act as starting points for the generation of pin holes and press forming cracks.

(2) Defects such as pin holes at the time of deep drawing are due not only to the presence of inclusions remaining in steel in the refining step described above in (1), but are also due to the presence of inclusions which are engulfed in slag during casting. These inclusions come from slag in a ladle or powder used at the time of continuous casting.

The present inventors obtained hot rolled steel sheet using slabs which were manufactured under conditions which solve the problems described above in (1) and (2). After descaling, cold rolling was carried out, and annealing treatment was then performed to obtain cold rolled steel sheet. It was found that this steel sheet could suppress the formation of forming defects such as pin hole defects and press cracks which originate at inclusions even when subjected to press forming of products of complicated shape with large deformation.

According to one aspect of the present invention, an ultra-low carbon steel sheet is made of a steel having a chemical composition containing, in mass percent, C: at most 0.010%, Si: at most 0.5%, Mn: at most 1.5%, P: at most 0.12%, S: at most 0.030%, Al: at most 0.080%, N: at most 0.0080%, and at least one of Ti: at most 0.10% and Nb: at most 0.05%, wherein the number of non-metallic inclusions observed in sixty fields under a microscope in a sample of the steel prepared in accordance with JIS G0555 is at most 20.

The steel may further include B: at most 0.0050%, V: at most 0.05%, and Ca: at most 0.0050%.

The steel will generally include various unavoidable components. In the present invention, Cu, Cr, Sn, and Sb may be present as unavoidable impurities, each in a maximum amount of 0.1%.

The present invention also provides a method for manufacturing an ultra-low carbon steel sheet. According to this aspect of the invention, molten steel having the above-described chemical composition is produced in a converter. The molten steel undergoes secondary refining, and it then undergoes continuous casting, hot rolling, cold rolling, and then continuous annealing to form an ultra-low carbon steel sheet. After refining in the converter, the molten steel is tapped into a refining vessel, e.g., a ladle, a vacuum immersion pipe having an interior which can be controlled to a negative pressure is immersed in the molten steel in the refining vessel, and stirring gas is blown into the molten steel.

After the secondary refining, continuous casting is carried out. The amount of (FeO)+(MnO) in the slag in the ladle is preferably controlled to at most 15 mass %, and the throughput during casting is preferably at most 5 tons per minute.

As a result of such a treatment method, the number of cluster-type inclusions having a particle diameter of at least 35 micrometers in a slab can be made 15,000 or less per 10 kg, and the number of spheroidal inclusions having a particle diameter of at least 35 micrometers in a slab can be made 400 or less per 10 kg.

According to an embodiment of the invention, hot rolling of a continuously cast slab having the above-described chemical composition is commenced with a slab average temperature of at least 1100° C., with the finishing temperature during finish rolling being at least the $Ar_3$ point, and with the coiling temperature being 450–750° C.

In the above-described hot rolling, heating or a short period of temperature holding process may be performed after rough rolling, and finish rolling is preferably completed at finishing temperature of at least the $Ar_3$ point over the entire length of the hot rolled coil.

A hot rolled steel sheet which is obtained in this manner is subjected to descaling and then to cold rolling with a reduction ratio of at least 45% and then is subjected to annealing. At this time, soaking may be carried out at a temperature of at least 650° C. when annealing is carried out by batch annealing and at a temperature of at least 750° C. when carried out by continuous annealing. Subsequently, temper rolling may be carried out.

According to the present invention, a steel sheet is obtained which can prevent forming defects such as pin hole defects and press cracks even when used in applications requiring severe press forming.

DESCRIPTION OF PREFERRED EMBODIMENTS

Figure 1:
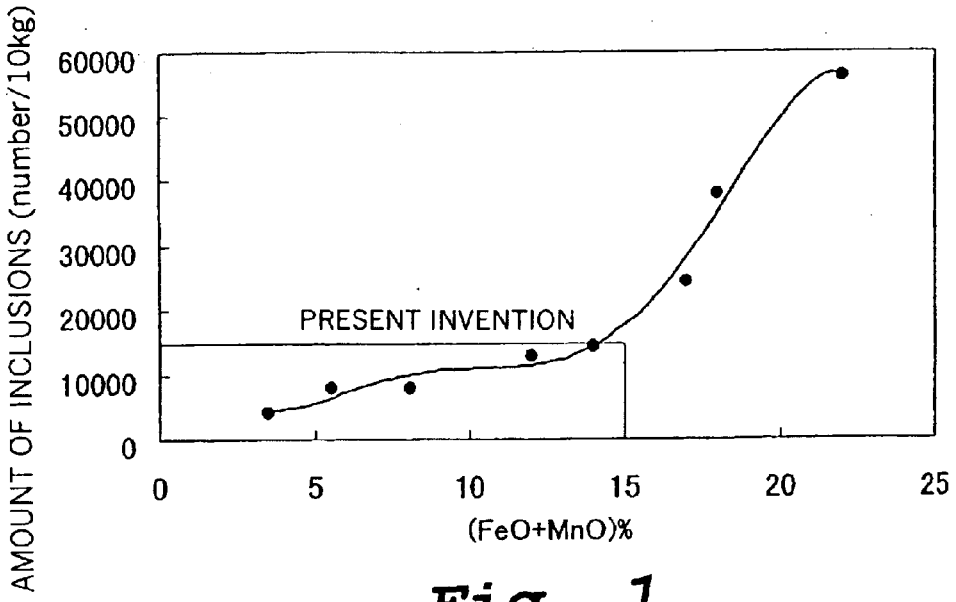
FIG. 1 is a graph showing the relationship between the amount of (FeO+MnO) in slag and the amount of cluster-type inclusions extracted from a slab.

The reasons for the limitations on the chemical compositions, the manufacturing conditions, and the form of inclusions in a steel according to the present invention will be explained. In this specification, "percent" when describing components in the chemical composition of steel or slag refers to mass percent unless otherwise specified.

(A) Chemical Composition of Steel

C: The present invention employs a molten steel in which a decarburization reaction is carried out using a vacuum degassing apparatus, so the amount of C is restricted to 0.010% or less which is a range which is impossible to achieve with just a converter. There is no particular lower limit. Preferably, the amount of C is at most 0.007%.

Si: Si is used as a deoxidation agent and as a strengthening component. In the present invention, Si is added as part of ferrosilicon after a decarburization reaction is completed using a vacuum degassing apparatus. If the amount of ferrosilicon which is added is too large, the amount of C in the molten steel as a whole becomes too large due to the C in the ferrosilicon, and the properties of the ultra-low carbon steel when formed into a product are deteriorated, so the upper limit on Si is made 0.5%. Preferably, the upper limit is 0.3%. There is no particular lower limit.

Mn: The effect of Mn is like that of Si, and the upper limit is made 1.5%. Preferably, the upper limit on Mn is 1.3%.

P: P is widely used as a solid solution strengthening component of cold rolled products. In the present invention, P is added as P-containing ferroalloy after the completion of the decarburization reaction. If the amount of P which is added as the ferroalloy is too large, the overall amount of C in the molten steel due to the C in the ferroalloy becomes too large, and the properties of a product obtained from the ultra-low carbon steel deteriorate, so the upper limit on P is 0.12%. There is no particular lower limit.

S: The amount of S is preferably as low as possible in order to prevent a deterioration in product properties. The upper limit is made 0.030%.

Ti: Among ultra-low carbon steels, so-called interstitial-free steel containing no solid solution C or solid solution N is much used because of its superior properties when formed into a product. In order to obtain such a steel, it is necessary for the amount of Ti to be sufficient to precipitate C and N as TiC and TiN. However, an excess amount of Ti not only produces an increase in costs, but also causes the properties of the product to deteriorate, so the upper limit on Ti is made 0.10%. Preferably, the amount of Ti is 0.002%–0.08%.

Nb: In order to obtain an interstitial-free steel, at most 0.05% of Nb is added instead of Ti or in addition to Ti. Preferably, Nb is added in addition to Ti, such as in an amount of at most 0.05%. Alternatively, Nb can be added together with B, and an excellent interstitial-free steel can be obtained. When both Ti and Nb are added, the amount of added Ti is preferably determined mainly for the purpose that N and S precipitate as TiN and TiS, with solid solution C remaining in order to give the steel bake hardenabilty. In any of the above cases, 0.05% is suitable as an upper limit on Nb. Preferably, the level of Nb is at most 0.02%.

Al: Al is added as a deoxidizing agent at the completion of the decarburization reaction using a vacuum degassing apparatus. If an excess amount is added, not only is the deoxidizing effect thereof diluted, but the amount of alumina inclusions is increased. Therefore, the upper limit on Al is made 0.080%. Preferably the amount of Al is at most 0.05%.

N: In an ultra-low carbon steel, the lower is the N content, the lower can be the amount of Ti which is added. The upper limit on N is made 0.0080% in order to suppress a deterioration in product properties due to an increase in inclusions. Preferably the amount of N is at most 0.0050%.

In addition to the above-described components, one or more of B, V, and Ca can be added to a steel according to the present invention in order to further improve press formability when manufacturing products of complicated shape with large deformation. The reasons for the limitations on the amounts of these elements are as follows.

B: B can be added as necessary in order to lessen brittleness during secondary forming, which is the greatest defect of a Ti-containing ultra-low carbon steel sheet when it undergoes severe press forming. In an ultra-low carbon steel sheet not containing Ti, B has the effect of precipitating solid solution N. Thus, B can be added whether or not Ti is present in the steel. In either case, the effect of B saturates at above 0.0050%, so this is made the upper limit.

V: In an ultra-low carbon steel, V may be added as necessary to precipitate C and N in solid solution as carbides and nitrides. The upper limit on its effectiveness is 0.05%.

Ca: Ca is a strong deoxidizing agent. It can be added as necessary in order to suppress clogging of a casting nozzle. If too large an amount is added, it increases the amount of Ca-type inclusions, so the upper limit thereon is 0.0050%.

Cu, Cr, Sn, Sb: If any of these is contained in a large amount as an unavoidable impurity, ductility is worsened and press cracks are formed, so the allowable upper limit on each of these is made.0.1%.

An ultra-low carbon steel according to this invention is manufactured in a conventional manner by converter refining, secondary refining comprising vacuum treatment, continuous casting, hot rolling, and then cold rolling, if necessary. Each of the manufacturing steps is preferably carried out under the prescribed conditions described below.

(B) Refining Conditions

FIG. 1 shows the results of an investigation of the relationship between the percent of lower oxides (FeO+MnO) in slag in a ladle after vacuum degassing and the amount of cluster-type inclusions (primarily alumina) in a slab after continuous casting.

As can be seen from FIG. 1, if the amount of (FeO+MnO) exceeds 15%, there is an abrupt increase in the amount of cluster-type inclusions.

Accordingly, the amount of (FeO+MnO) is restricted to a range in which this abrupt increase does not occur, i.e., it is made at most 15%. As a result, the number of cluster-type inclusions having a particle diameter of at least 35 micrometers extracted by the slime method can be restricted to 15,000 or fewer per 10 kg.

(C) Casting Conditions

Figure 2:
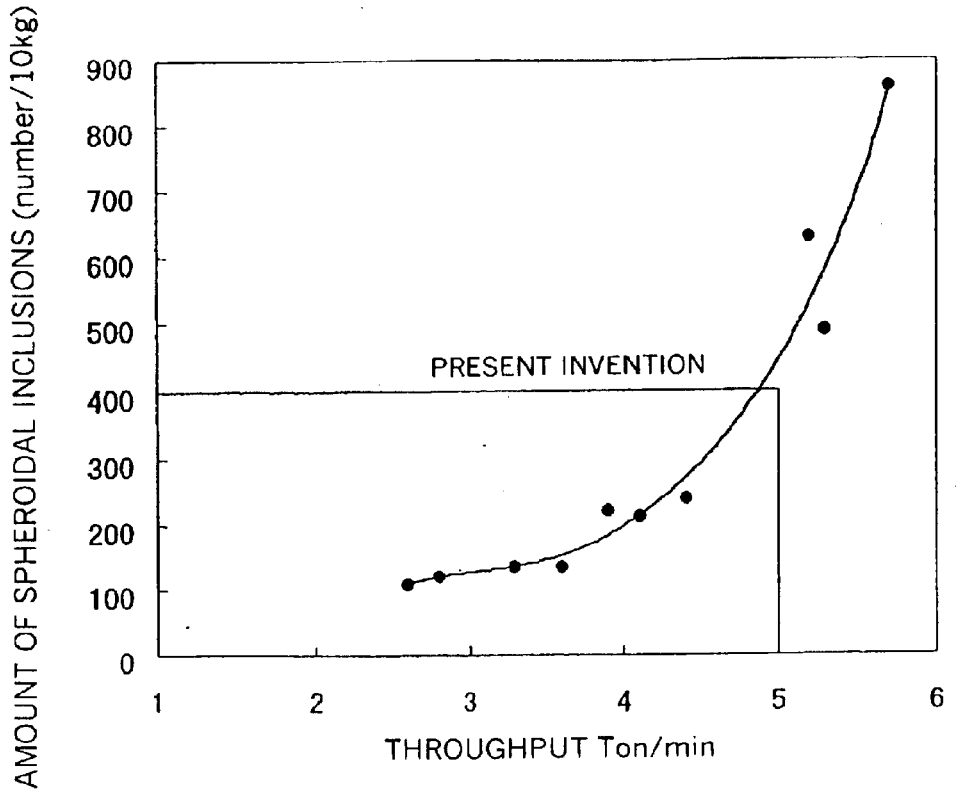
FIG. 2 is a graph showing the relationship between throughput during continuous casting and the amount of spheroidal inclusions extracted from a slab formed by the continuous casting.

FIG. 2 shows the results of investigations of the relationship between the throughput from a nozzle during continuous casting and the amount of oxide-type spheroidal inclusions having a particle diameter of at least 35 micrometers which are thought to be entrained in the steel during casting and which are derived from slag in the ladle or from mold powder used during continuous casting.

As can be seen from FIG. 2, the amount of spheroidal inclusions abruptly increases when the throughput exceeds 5 tons per minute. Accordingly, in the present invention, the throughput is made at most 5 tons per minute, and as a result, the number of spheroidal inclusions having a size of at least 35 micrometers extracted by the slime method can be restricted to 400 or fewer per 10 kg.

(D) Vacuum Refining Conditions

An RH vacuum degassing apparatus is typically used as a vacuum degassing apparatus using a vacuum immersion pipe in the present invention.

Figure 3:
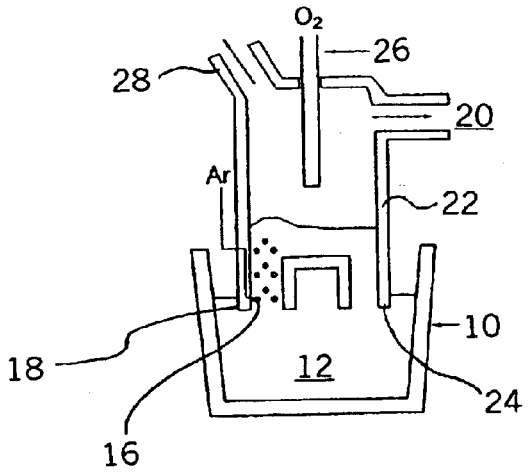
FIG. 3 is a schematic illustration of an RH vacuum degassing apparatus.

FIG. 3 is a schematic illustration of such an apparatus. Molten steel 12 within a ladle 10 circulates through a rising pipe 18 equipped with an argon blowing nozzle 16, a vacuum vessel 22 connected to the rising pipe 18 and to a vacuum exhaust system 20, and a descending pipe 24 connected to the vacuum vessel 22. The interior of the vacuum vessel 22 is evacuated, and degassing is carried out therein. Decarburization is carried out by blowing oxygen gas from a lance 26 which can be raised and lowered. Final adjustment of components is carried out by charging alloy components through an alloy charging port 28.

Figure 4:
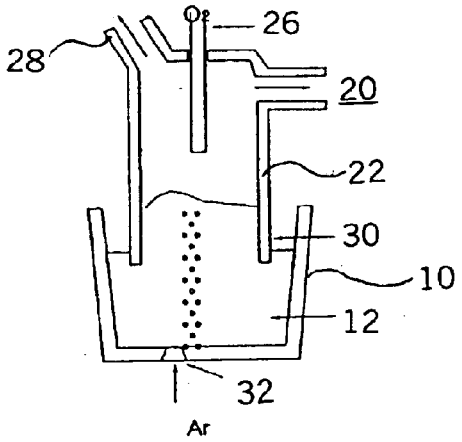
FIG. 4 is a schematic view of a vacuum degassing apparatus having a single-tube immersion pipe.

FIG. 4 shows another example of a vacuum degassing apparatus using a vacuum immersion pipe, which can be employed in the present invention. In this figure, a single-tube immersion pipe 30 having an interior which can be adjustably reduced in pressure is used as a vacuum vessel 22. Argon gas is blown into the molten steel from a porous nozzle 32 provided in the bottom of the ladle 10. Molten steel 12 is drawn into the immersion pipe 30 by the vacuum inside the immersion pipe 30. The operation is otherwise the same as with the apparatus of FIG. 3.

Vacuum refining of molten steel was carried out in the immersion pipe 30 of a degassing apparatus like that shown in FIG. 4 having a single-tube immersion pipe with an interior atmosphere which could be adjustably reduced in pressure. The immersion pipe 30 was immersed in molten steel in a refining vessel, i.e., ladle, argon gas was introduced into the molten steel as a stirring gas, and continuous casting was carried out after vacuum refining of the molten steel. The number of cluster-type inclusions having a size of at least 35 micrometers which were extracted by the slime method from the resulting slab was investigated. It was determined that the number of cluster-type inclusions was at most 15,000 per 10 kg.

In this vacuum refining method, stirring of slag in a ladle is possible, so after decarburization under reduced pressure and the addition of Al, reduction of FeO+MnO in the slag in the ladle can be carried out using Al in the molten steel, and as a result, the amount of (FeO+MnO) remaining after treatment can be easily reduced. Furthermore, it was found that the number of inclusions can be further reduced by adjusting the ratio $D/D_0$ of the inner diameter D (in meters) of the immersion pipe 30 to the inner diameter $D_0$ (in meters) of the ladle 10.

Figure 5:
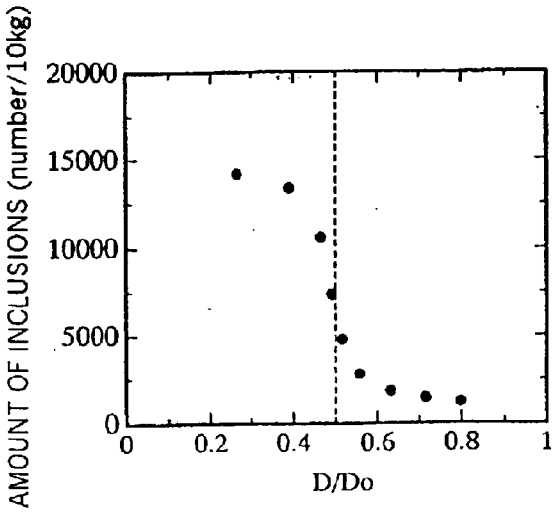
FIG. 5 is a graph showing the relationship between the ratio of the diameter D of an immersion pipe to the diameter $D_0$ of a ladle and the amount of inclusions extracted from a slab.

FIG. 5 shows the relationship between $D/D_0$ and the number of inclusions. It can be seen that it is desirable to have $D/D_0$ be at least 0.5 in order to reduce the number of inclusions. If $D/D_0$ is less than 0.5, the amount of slag which can be received in the immersion pipe 30 is small, so the ability to reduce lower oxides in the slag is reduced.

(E) Hot Rolling and Cold Rolling Conditions

Basically, the lower is the heating temperature of the slab, the finer are the crystal grains after hot rolling, which is desirable in a material to be cold rolled. However, it is also required that the finishing temperature of hot rolling be maintained at or above the $Ar_3$ point. For this reason, irrespective of whether reheating is performed, whether temperature holding process or soaking is performed with direct charge rolling, or whether direct charge rolling+ heating is employed, the starting temperature of hot rolling is at least 1100° C.

The finishing temperature for hot rolling is maintained at or above the $Ar_3$ point over the entire length of the steel plate in order to obtain a product with good properties. When the finishing temperature is less than the $Ar_3$ point, a crystal orientation which is undesirable for formability is produced, and when the rolled product is subjected to press forming to manufacture products of complicated shape with large deformation, there are cases in which press-forming cracks and the like due to inadequate formability and not caused by inclusions occur. As a means of ensuring that the finishing temperature be at $Ar_3$ or above, it is possible to perform reheating of the rough rolled bar, or to perform temperature holding process to obtain a uniform temperature, or to perform continuous direct finish rolling.

The higher is the coiling temperature after hot rolling, the softer is the hot rolled plate, and the more suitable is the plate for deep drawing applications. However, if the coiling temperature is more than 750° C., friction decreases, and coiling with a coiler becomes difficult. In addition, by suitably lowering the coiling temperature for a high strength steel sheet or the like, the strength of the product can be adjusted, but the effect is small if lower than 450° C., so this is made the lower limit on the coiling temperature.

The cold rolling reduction is made at least 45% in order to obtain a cold rolled product having good formability, a precise thickness, and good surface properties. As a result, it is possible to suppress press cracks and the like caused by inadequate formability not caused by inclusions.

In order to promote recrystallization after cold rolling and crystal grain growth and obtain good formability, the annealing temperature is made at least 650° C. for batch annealing and at least 750° C. for continuous annealing. With such a temperature, it is possible to suppress press cracks and the like caused by inadequate formability and not caused by inclusions.

It is sufficient to satisfy one or more of the above-described refining conditions, casting conditions, vacuum refining conditions, and hot and cold rolling conditions, but the more conditions that are satisfied, the more suitable is the resulting ultra-low carbon steel sheet for use in severe press forming of products of a complicated shape.

(F) Inclusions in the Rolled Product

The amount of inclusions in rolled steel sheet such as cold rolled steel sheet manufactured by the above method is extremely small. When non-metallic inclusions were measured by the method set forth in JIS G0555, almost all inclusions were classified as $C_1$ or $C_2$. Conventionally, a sample is observed under a microscope with a standard rectangular grid superimposed on the sample, and the number of grid points coinciding with inclusions in the sample is counted. However, the inclusions in a steel according to the present invention are so small and dispersed that the standard counting method gives a value of 0% and thus cannot be used to accurately determine the quality of the steel.

Therefore, the quality of a steel according to the present invention is evaluated by a modification of the method set forth in JIS G0555. In the modified method, the total number of non-metallic inclusions observed under a microscope in 60 fields is counted, regardless of whether the inclusions coincide with grid points.

The method of measuring inclusions according to the present invention based on JIS G0555 was as follows. First, a test piece was cut from the central portion along the rolling direction, a surface was polished, 60 fields on the sample were observed with a microscope at a magnification of 400 times, and the total number of inclusions observed in the 60 fields was counted.

When a steel plate according to the present invention having at most 20 observed inclusions in 60 fields is subjected to press forming of products of complicated shape with large deformation, forming defects such as pin hole defects and drawing cracks originating at inclusions are not formed.

A cold rolled steel sheet which is obtained in this manner can then be subjected to surface treatment such as electroplating or painting. It is of course also possible to carry out continuous hot dip galvanizing.

Depending on the situation, it is possible to use the present invention as hot rolled steel sheet, and there are no particular restrictions in this regard.

The thickness of the ultra-low carbon steel sheet according to the present invention is preferably at least 0.30 millimeters, and while there is no upper limit, the limit on the thickness for press forming is typically at most 6 millimeters.

EXAMPLES

Table 1 shows the components of molten steel of a test material used in this example, Table 2 shows the slag composition, the number of cluster-type inclusions in a slab, the casting conditions, and the number of spheroidal inclusions in a cast slab. Table 3 shows the properties of the product.

Formability was evaluated by performing a cylindrical deep drawing test with a drawing ratio of 1.8, and the percent of defects formed in the side wall was evaluated. This test is more severe than the evaluation of formability for can manufacture, and it evaluates the formability for "applications to products of complicated shape with large deformation".

There were cases in which drawing cracks were formed due to inferior formability, and cases in which pin holes were formed in the side wall even when drawing was possible. In either case, the steel was evaluated as defective.

The results are shown in Table 3.

According to the present invention, it is clear that a rolled steel sheet is obtained which does not have surface defects such as pin holes or poor formability due to inclusions even if press forming of products of complicated shape with large deformation is carried out.

TABLE 1

| Steel No. | Chemical Composition (mass %) | | | | | | | | | | | | | | | |
|---|---|---|---|---|---|---|---|---|---|---|---|---|---|---|---|---|
| | C | Si | Mn | P | S | Ti | Nb | Al | N | B | V | Ca | Cu | Cr | Sn | Sb |
| 1 | 0.0033 | 0.02 | 0.19 | 0.014 | 0.008 | 0.056 | — | 0.027 | 0.0024 | 0.0005 | 0.01 | — | 0.03 | 0.02 | 0.0080 | 0.0031 |
| 2 | 0.0012 | 0.05 | 0.22 | 0.013 | 0.007 | 0.023 | 0.008 | 0.031 | 0.0018 | 0.0001 | — | 0.0002 | 0.02 | 0.04 | 0.0005 | 0.0007 |
| 3 | 0.0024 | 0.01 | 0.36 | 0.034 | 0.004 | 0.007 | 0.007 | 0.031 | 0.0021 | — | — | — | 0.02 | 0.02 | 0.0004 | 0.0011 |
| 4 | 0.0028 | 0.08 | 0.38 | 0.031 | 0.005 | 0.008 | 0.006 | 0.027 | 0.0018 | — | — | — | 0.02 | 0.01 | 0.0003 | 0.0035 |
| 5 | 0.0054 | 0.11 | 1.40 | 0.090 | 0.010 | 0.059 | 0.018 | 0.023 | 0.0045 | 0.0014 | — | 0.0001 | 0.01 | 0.03 | 0.0030 | 0.0004 |
| 6* | 0.0400* | 0.01 | 0.26 | 0.015 | 0.006 | —* | —* | 0.038 | 0.0032 | — | — | — | 0.03 | 0.02 | 0.0030 | 0.0015 |
| 7* | 0.0034 | 0.03 | 0.19 | 0.013 | 0.012 | 0.120* | — | 0.087* | 0.0033 | — | — | 0.0011 | 0.03 | 0.05 | 0.0004 | 0.0033 |
| 8* | 0.0022 | 0.85* | 1.70* | 0.150* | 0.006 | 0.088 | 0.022 | 0.026 | 0.0017 | 0.0026 | — | — | 0.06 | 0.03 | 0.0010 | 0.0055 |
| 9 | 0.0025 | 0.02 | 0.23 | 0.015 | 0.004 | 0.021 | 0.007 | 0.028 | 0.0022 | 0.0001 | — | — | 0.02 | 0.01 | 0.0003 | 0.0011 |
| 10 | 0.0024 | 0.01 | 0.21 | 0.013 | 0.005 | — | 0.022 | 0.031 | 0.0019 | 0.0018 | — | — | 0.01 | 0.02 | 0.0004 | 0.0012 |
| 11 | 0.0022 | 0.01 | 0.19 | 0.012 | 0.004 | 0.070 | — | 0.029 | 0.0021 | 0.0003 | — | — | 0.02 | 0.01 | 0.0002 | 0.0009 |
| 12 | 0.0018 | 0.02 | 0.22 | 0.014 | 0.004 | 0.033 | 0.008 | 0.032 | 0.0023 | 0.0003 | — | — | 0.02 | 0.01 | 0.0005 | 0.0008 |
| 13 | 0.0016 | 0.05 | 0.24 | 0.016 | 0.005 | 0.041 | 0.010 | 0.027 | 0.0024 | — | — | — | 0.02 | 0.02 | 0.0003 | 0.0011 |

*Outside the range of the present invention

TABLE 2

| Steel No. | Refining Conditions | | | Slab | Casting | Slab | Hot Rolling Conditions | | | |
|---|---|---|---|---|---|---|---|---|---|---|
| | Secondary Refining Apparatus | $D/D_0$ | FeO+ MnO (mass %) | Number of cluster-type inclusions (number/10 kg) | Conditions Throughput Ton/min) | Number of spheroidal inclusions (number/10 kg) | Hot rolling starting temp (° C.) | Temperature Holding | Finishing temp (° C.) | Coiling temp (° C.) |
| 1a | RH | — | 8.0 | 8070 | 3.9 | 220 | 1120 | None | 920 | 680 |
| 1b | | | | | 5.7 | 860 | 1140 | None | 930 | 680 |
| 1c | | | | | 3.9 | 220 | 1040 | Rough bar heater | 900 | 680 |
| 1d | | | | | 3.9 | 220 | 1040 | None | 850 | 680 |
| 2a | RH | — | 3.5 | 4210 | 4.4 | 236 | 1100 | None | 930 | 580 |
| 2b | | | | | 4.4 | 236 | 1100 | None | 910 | 580 |
| 2c | | | | | 5.2 | 630 | 1100 | None | 930 | 580 |
| 2d | | | | | 5.2 | 630 | 1100 | None | 930 | 580 |
| 3a | RH | — | 18.0 | 38000 | 2.8 | 121 | 1080 | None | 900 | 610 |
| 4a | RH | — | 5.5 | 8030 | 3.6 | 134 | 1090 | None | 900 | 610 |
| 5a | RH | — | 14.0 | 14600 | 2.6 | 108 | 1160 | None | 890 | 710 |
| 5b | | | | | 2.6 | 108 | 1060 | Rough bar heater | 900 | 710 |
| 5c | | | | | 2.6 | 108 | 1060 | Rough bar heater | 900 | 400 |
| 6a | RH | — | 3.0 | 310 | 5.4 | 32 | 880 | None | 880 | 650 |
| 7a | RH | — | 12.0 | 13080 | 5.3 | 490 | 1120 | None | 920 | 650 |
| 7b | | | | | 3 | 135 | 1100 | None | 920 | 650 |
| 8a | RH | — | 22.0 | 56500 | 4.1 | 210 | 1050 | Rough bar heater | 950 | 700 |
| 9a | Single-Tube | 0.40 | 12.1 | 13100 | 4.2 | 280 | 1080 | None | 910 | 600 |
| 9b | immersion pipe | | | | 5.2 | 495 | 1080 | None | 910 | 600 |
| 10a | Single-Tube | 0.48 | 10.3 | 10800 | 3.0 | 158 | 980 | Rough bar heater | 900 | 560 |
| 10b | immersion pipe | | | | 5.4 | 710 | 980 | Rough bar heater | 900 | 560 |
| 11a | Single-Tube | 0.55 | 3.3 | 2600 | 2.5 | 140 | 1080 | None | 900 | 680 |
| 11b | immersion pipe | | | | 5.6 | 750 | 1080 | None | 900 | 680 |
| 12a | Single-Tube | 0.62 | 3.3 | 2100 | 3.8 | 110 | 1040 | None | 920 | 650 |
| 12b | immersion pipe | | | | 5.2 | 530 | 1040 | None | 920 | 650 |
| 13 | Single-Tube | 0.71 | 3.1 | 1300 | 4.3 | 230 | 1060 | None | 900 | 560 |
| 13b | immersion pipe | | | | 5.7 | 770 | 1060 | None | 900 | 560 |

| Steel No. | Cold Rolling Conditions | | | |
|---|---|---|---|---|
| | Annealing type | Annealing temp (° C.) | | Classification |
| 1a | CAL | 810 | ◎ | Present Invention |
| 1b | CAL | 811 | Δ | Comparative |
| 1c | CAL | 810 | ◎ | Present Invention |
| 1d | CAL | 810 | ○ | Comparative |
| 2a | CGL | 830 | ◎ | Present Invention |
| 2b | BAF | 700 | ◎ | Present Invention |

TABLE 2-continued

| | | | | |
|---|---|---|---|---|
| 2c | CGL | 830 | Δ | Comparative |
| 2d | BAF | 710 | Δ | Comparative |
| 3a | CAL | 800 | Δ | Comparative |
| 4a | CAL | 800 | ⊙ | Present Invention |
| 5a | CGL | 820 | ⊙ | Present Invention |
| 5b | CGL | 820 | ⊙ | Present Invention |
| 5c | CGL | 820 | ○ | Comparative |
| 6a | CAL | 780 | x | Comparative |
| 7a | CGL | 800 | x, Δ | Comparative |
| 7b | CGL | 800 | x | Comparative |
| 8a | CGL | 820 | x, Δ | Comparative |
| 9a | CAL | 800 | ⊙ | Present Invention |
| 9b | CAL | 800 | Δ | Comparative |
| 10a | CGL | 800 | ⊙ | Present Invention |
| 10b | CGL | 800 | Δ | Comparative |
| 11a | CGA | 830 | ⊙ | Present Invention |
| 11b | CAL | 830 | Δ | Comparative |
| 12a | CGL | 830 | ⊙ | Present Invention |
| 12b | CGL | 830 | Δ | Comparative |
| 13 | BAF | 700 | ⊙ | Present Invention |
| 13b | BAF | 700 | Δ | Comparative |

Notes:
Rough bar heater: This was an apparatus for carrying out heating or a short period of temperature holding after rough rolling during hot rolling
BAF: batch annealing
CAF: continuous annealing
CGL: continuous hot dip galvanizing

TABLE 3

| | Product Properties | | | | | | | | | | |
|---|---|---|---|---|---|---|---|---|---|---|---|
| Steel No. | Type of Product | Number of observed inclusions | Sheet thick-ness (mm) | YP ($N/mm^2$) | TS ($N/mm^2$) | EL (%) | r-value | Rate of forming defects (%) | Cause of forming defects | | Classification |
| 1a | Electroplated plate | 12 | 0.70 | 144 | 310 | 48 | 1.9 | 0 | — | ⊙ | Present Invention |
| 1b | Electroplated plate | 29 | 0.70 | 135 | 305 | 48 | 1.9 | 3.1** | pin holes | Δ | Comparative |
| 1c | Cold Rolled plate | 8 | 0.65 | 135 | 308 | 47 | 2.0 | 0 | — | ⊙ | Present Invention |
| 1d | Cold Rolled plate | 11 | 0.65 | 122 | 267 | 41 | 1.2** | 23.0** | drawing cracks | ○ | Comparative |
| 2a | Molten-Metal-Coated plate | 7 | 0.75 | 126 | 297 | 50 | 2.0 | 0 | — | ⊙ | Present Invention |
| 2b | Cold Rolled plate | 3 | 0.90 | 153 | 317 | 45 | 1.7 | 0 | — | ⊙ | Present Invention |
| 2c | Molten-Metal-Coated plate | 38 | 0.75 | 131 | 301 | 49 | 2.0 | 7.2** | pin holes | Δ | Comparative |
| 2d | Cold Rolled plate | 56 | 0.90 | 144 | 312 | 47 | 1.7 | 2.3** | pin holes | Δ | Comparative |
| 3a | Cold Rolled plate | 131 | 0.70 | 210 | 353 | 42 | 1.7 | 12.0** | pin holes | Δ | Comparative |
| 4a | Cold Rolled plate | 8 | 0.70 | 221 | 358 | 41 | 1.8 | 0 | — | ⊙ | Present Invention |
| 5a | Molten-Metal-Coated plate | 16 | 1.40 | 306 | 453 | 34 | 1.8 | 0 | — | ⊙ | Present Invention |
| 5b | Molten-Metal-Coated plate | 10 | 1.40 | 310 | 451 | 33 | 1.7 | 0 | — | ⊙ | Present Invention |
| 5c | Molten-Metal-Coated plate | 5 | 1.40 | 380 | 501 | 27 | 1.3** | 31.0** | drawing cracks | ○ | Comparative |
| 6a | Cold Rolled plate | 8 | 0.50 | 230 | 344 | 36 | 1.1** | 58.0** | drawing cracks | x | Comparative |
| 7a | Molten-Metal-Coated plate | 83 | 1.20 | 228 | 342 | 46 | 1.3** | 35.0** | pin holes, drawing cracks | x, Δ | Comparative |
| 7b | Molten-Metal-Coated plate | 13 | 1.20 | 231 | 338 | 47 | 1.3** | 24.0** | drawing cracks | x | Comparative |
| 8a | Molten-Metal-Coated plate | 77 | 1.60 | 398 | 520 | 27 | 1.2** | 85.0** | pin holes, drawing cracks | x, Δ | Comparative |
| 9a | Electroplated plate | 15 | 0.90 | 121 | 288 | 51 | 2.1 | 0 | — | ⊙ | Present Invention |
| 9b | Electroplated plate | 48 | 0.90 | 123 | 290 | 51 | 2.1 | 4.2** | pin holes | Δ | Comparative |
| 10a | Molten-Metal-Coated plate | 13 | 0.65 | 133 | 296 | 49 | 2.0 | 0 | — | ⊙ | Present Invention |
| 10b | Molten-Metal-Coated plate | 88 | 0.65 | 131 | 298 | 50 | 2.0 | 4.5** | pin holes | Δ | Comparative |
| 11a | Cold Rolled plate | 10 | 0.45 | 118 | 277 | 51 | 2.3 | 0 | — | ⊙ | Present Invention |
| 11b | Cold Rolled plate | 200 | 0.45 | 125 | 280 | 49 | 2.3 | 3.0** | pin holes | Δ | Comparative |
| 12a | Molten-Metal-Coated plate | 7 | 0.65 | 133 | 308 | 50 | 2.2 | 0 | — | ⊙ | Present Invention |
| 12b | Molten-Metal-Coated plate | 75 | 0.65 | 132 | 305 | 51 | 2.3 | 2.5** | pin holes | Δ | Comparative |
| 13a | Cold Rolled plate | 3 | 0.90 | 134 | 308 | 48 | 1.9 | 0 | — | ⊙ | Present Invention |
| 13b | Cold Rolled plate | 124 | 0.90 | 138 | 305 | 49 | 2.0 | 1.7** | pin holes | Δ | Comparative |

Note:
**Did not satify target properties
Classification:
⊙: Present invention, ○: Unacceptable rolling conditions, Δ: Unacceptable steel manufacturing conditions,
x: Unacceptable composition As described above, a rolled steel plate according to the present invention and a surface treated steel plate obtained by surface treatment of the rolled steel plate does not develop pin hole defects or drawing cracks and the like originating at inclusions even if used for applications to products of complicated shape with large deformation, such as electric motor housings or oil filter housings, so the present invention is very significant from a commercial standpoint.

What is claimed is:

1. An ultra-low carbon steel having a chemical composition including, in mass percent, C: at most 0.010%, Si: at most 0.5%, Mn: at most 1.5%, P: at most 0.12%, S: at most 0.030%, Al: more than 0.01%, and at most 0.080%, N: at most 0.0080%, one or both of Ti: at most 0.10% and Nb: at most 0.05%, B: 0–0.0050%, V: 0–0.05%, Ca: 0–0.0050%, and at most 0.1% of each of Cu, Cr, Sn, and Sb as unavoidable components, wherein the total number of non-metallic inclusions observed in 60 fields under a microscope in a sample of the steel prepared in accordance with JIS G0555 is at most 20.

2. An ultra-low carbon steel as claimed in claim 1 wherein the chemical composition further includes B: at most 0.0050%.

3. An ultra-low carbon steel as claimed in claim 1 wherein the chemical composition further includes V: at most 0.05%.

4. An ultra-low carbon steel as claimed in claim 2 wherein the chemical composition further includes V: at most 0.05%.

5. An ultra-low carbon steel as claimed in claim 1 wherein the chemical composition further includes Ca: at most 0.0050%.

6. An ultra-low carbon steel as claimed in claim 2 wherein the chemical composition further includes Ca: at most 0.0050%.

7. An ultra-low carbon steel as claimed in claim 3 wherein the chemical composition further includes Ca: at most 0.0050%.

8. An ultra-low carbon steel as claimed in claim 4 wherein the chemical composition further includes Ca: at most 0.0050%.

9. An ultra-low carbon steel as claimed in claim 1 wherein the chemical composition further includes a maximum of 0.1% of each of Cu, Cr, Sn, and Sb as unavoidable components.

10. An ultra-low carbon steel as claimed in claim 2 wherein the chemical composition further includes a maximum of 0.1% of each of Cu, Cr, Sn, and Sb as unavoidable components.

11. An ultra-low carbon steel as claimed in claim 3 wherein the chemical composition further includes a maximum of 0.1% of each of Cu, Cr, Sn, and Sb as unavoidable components.

12. An ultra-low carbon steel as claimed in claim 4 wherein the chemical composition further includes a maximum of 0.1% of each of Cu, Cr, Sn, and Sb as unavoidable components.

13. An ultra-low carbon steel as claimed in claim 5 wherein the chemical composition further includes a maximum of 0.1% of each of Cu, Cr, Sn, and Sb as unavoidable components.

14. An ultra-low carbon steel sheet made of a steel having a chemical composition including, in mass percent, C: at most 0.010%, Si: at most 0.5%, Mn: at most 1.5%, P: at most 0.12%, S: at most 0.030%, Al: more than 0.01%, and at most 0.080%, N: at most 0.0080%, one or both of Ti: at most 0.10% and Nb: at most 0.05%, B: 0–0.0050%, V: 0–0.05%, Ca: 0–0.0050%, and at most 0.1% of each of Cu, Cr, Sn, and Sb as unavoidable components, wherein the total number of non-metallic inclusions observed in 60 fields under a microscope in a sample of the steel prepared in accordance with ITS G0555 is at most 20.

15. An ultra-low carbon steel sheet as claimed in claim 14 wherein the chemical composition further includes B: at most 0.0050%.

16. An ultra-low carbon steel sheet as claimed in claim 14 wherein the chemical composition further includes V: at most 0.05%.

17. An ultra-low carbon steel sheet as claimed in claim 15 wherein the chemical composition further includes V: at most 0.05%.

18. An ultra-low carbon steel sheet as claimed in claim 14 wherein the chemical composition further includes Ca: at most 0.0050%.

19. An ultra-low carbon steel sheet as claimed in claim 15 wherein the chemical composition further includes Ca: at most 0.0050%.

20. An ultra-low carbon steel sheet as claimed in claim 16 wherein the chemical composition further includes Ca: at most 0.0050%.

21. An ultra-low carbon steel sheet as claimed in claim 17 wherein the chemical composition further includes Ca: at most 0.0050%.

22. An ultra-low carbon steel sheet as claimed in claim 14 wherein the chemical composition further includes a maximum of 0.1% of each of Cu, Cr, Sn, and Sb as unavoidable components.

23. An ultra-low carbon steel sheet as claimed in claim 15 wherein the chemical composition further includes a maximum of 0.1% of each of Cu, Cr, Sn, and Sb as unavoidable components.

24. An ultra-low carbon steel sheet as claimed in claim 16 wherein the chemical composition further includes a maximum of 0.1% of each of Cu, Cr, Sn, and Sb as unavoidable components.

25. An ultra-low carbon steel sheet as claimed in claim 17 wherein the chemical composition further includes a maximum of 0.1% of each of Cu, Cr, Sn, and Sb as unavoidable components.

26. An ultra-low carbon steel sheet as claimed in claim 18 wherein the chemical composition further includes a maximum of 0.1% of each of Cu, Cr, Sn, and Sb as unavoidable components.

27. An ultra-low carbon steel as claimed in claim 1 wherein the Al is at least 0.0 15% and the C is at most 0.007%.

28. An ultra-low carbon steel as claimed in claim 1 wherein the Al is at least 0.020% and the C is at most 0.007%.

29. An ultra-low carbon steel sheet as claimed in claim 14 wherein the Al is at least 0.015% and the C is at most 0.007%.

30. An ultra-low carbon steel sheet as claimed in claim 14 wherein the Al is at least 0.020% and the C is at most 0.007%.

* * * * *